US006493912B1

(12) United States Patent
Ho

(10) Patent No.: US 6,493,912 B1
(45) Date of Patent: Dec. 17, 2002

(54) STONE SETTING METHODS

(75) Inventor: Nelson Chi-Kai Ho, Hong Kong (CN)

(73) Assignee: China Diamond Production Company Limited, Kowloon (CN)

( * ) Notice: Subject to any disclaimer, the term of this patent is extended or adjusted under 35 U.S.C. 154(b) by 8 days.

(21) Appl. No.: 09/610,504

(22) Filed: Jul. 6, 2000

Related U.S. Application Data

(63) Continuation-in-part of application No. 09/145,751, filed on Sep. 2, 1998, now abandoned.

(51) Int. Cl.[7] ..... B23P 5/00

(52) U.S. Cl. ..... 29/10; 29/896.41; 63/26; 63/32; 164/35

(58) Field of Search ..... 29/10, 896.41; 63/26, 32; 164/35, 45

(56) References Cited

U.S. PATENT DOCUMENTS 4,392,289 A * 7/1983 Michaud ..... 164/35
5,115,649 A * 5/1992 Amber ..... 63/26
5,649,434 A * 7/1997 Itzkowitz ..... 63/26
5,690,477 A * 11/1997 Haimoff ..... 164/9
5,881,795 A * 3/1999 Uptain ..... 164/9

* cited by examiner

*Primary Examiner*—P. W. Echols
(74) *Attorney, Agent, or Firm*—Alix, Yale & Ristas, LLP

(57) ABSTRACT

A method of producing stone set jewelry includes the step of forming at least one affixation groove within the stone to be set in the jewelry. A stone to be set with the present method should have an upper and a lower portion which is at least substantially entirely hidden from view when the upper portion of the stone is viewed. In accordance with the present method the affixation groove should be formed in the lower portion of the stone such that it too is hidden from view when the upper portion of the stone is viewed. A heat setting method is disclosed for improving the bond between the pavilion of the stone and the wax model used in the casting process. The method also includes the deposition of a mounting material within the affixation groove by applying a conventional casting method. Finally, any excess deposited mounting material can be removed and the stone affixed to the article of jewelry via the mounting material such that the mounting material of a completed article of jewelry is not visible when the stone is viewed from the upper portion thereof. New articles of jewelry formed from the methods of producing jewelry are also disclosed.

9 Claims, 21 Drawing Sheets

STONE SETTING METHODS

CROSS REFERENCE TO RELATED APPLICATION

This application is a continuation in part of U.S. application Ser. No. 09/145,751, filed Sep. 2, 1998 now abandoned.

BACKGROUND OF THE INVENTION

1. Field of the Invention

The present invention generally relates to the fields of jewelry and jewelry manufacturing. More particularly, the invention concerns methods of producing articles of jewelry with one or more stones discretely mounted thereon.

2. Description of the Related Art

The use of stones as decorative elements of jewelry is extremely widespread and dates back thousands of years. Among the more popular precious and semi-precious stones used in such jewelry are diamonds, emeralds, rubies, opals and sapphires. Jewels such as these are commonly set in rings, bracelets, necklaces, earrings, etc. which are primarily made of metal such as gold, silver, platinum, etc. Such articles of jewelry utilize 'settings' to mount the stones onto the carrying portion of the jewelry and shall be referred to herein as "stone set" jewelry.

In addition to manufacturing considerations found in any sphere of mass production, jewelry designers and producers place a premium on the overall aesthetics of an article of jewelry. Thus, jewelry designers have striven to create the most attractive works possible at a minimum cost. In large part, the overall beauty of stone set jewelry is derived from the quality and brilliance of the stones used therein. Since the manner in which a stone is set into an article of jewelry is a major factor in determining the quality of the overall work, the stone used in an article of jewelry must be retained therein in a manner which emphasizes the brilliance of the stone. Accordingly, jewelry manufacturers have long striven to develop methods of retaining stones within jewelry in the least obtrusive manner possible.

Unfortunately, stone settings used in conventional jewelry invariably interfere with the visual appearance of the stones themselves. This is true regardless of whether such jewelry is prong set, channel set or bezel set, etc. For example, prong set jewelry typically utilizes four prongs which extend from the stone carrying portion of the jewelry over the top of the stone to secure the stone against movement. Restated in more conventional terms, in prong set jewelry, stones are retained in the jewelry by the use of prongs which emanate from below the pavilion of the stone, extend over the girdle and terminate on the table of the stone. This manner of affixing stones to jewelry necessarily causes at least some degradation of the stone's brilliance due to the fact that at least a portion of the stone is covered by the prongs. Thus, in order to achieve a given level of brilliance, a higher quality stone must be used to compensate for the presence of such prongs. Naturally, this leads to increased costs. Finally, the fact that the conventional method of setting stones in jewelry occurs on an individual basis further increases costs relative to a method in which multiple settings can be simultaneously formed.

SUMMARY OF THE INVENTION

Accordingly, an object of the present invention is to provide methods of producing jewelry of the type having stones set in a carrying member wherein the setting is not visible when the jewelry is viewed from the top side of the stones.

It is also an object of the present invention to provide methods of producing jewelry of the type having clusters of stones set in a carrying member wherein the setting for each of the stones in each cluster are produced simultaneously.

A further object of the present invention is to provide methods of producing jewelry of the type having stones set in a carrying member, such methods reducing manufacturing wastes, costs and production times.

Still another object of the present invention is to provide methods of producing jewelry of the type having stones set in a carrying member wherein the stones can be set in the jewelry simultaneously with the casting of the remainder of the article of jewelry.

Yet another object of the present invention is to provide an improved method of mounting stones to the wax jewelry models used in conjunction with lost-wax casting.

It is still another object of the present invention to provide methods of producing jewelry utilizing precious and semi-precious stones wherein the stones appear to be of higher quality than stones of comparable value when set in conventional jewelry.

It is a further object of the present invention to provide methods of producing jewelry of the general character noted above, such methods offering an optimal combination of versatility, economy, simplicity and efficiency.

These and other objects and advantages of the present invention are provided in one embodiment by providing methods of producing stone set jewelry in which at least one affixation groove is formed within the stone to be set therein. The stone should have an upper and a lower portion which is at least substantially entirely hidden from view when the upper portion of the stone is viewed. The affixation groove should be formed in the lower portion of the stone such that it too is hidden from view when the upper portion of the stone is viewed.

The inventive method further comprises the deposition of a mounting material within the affixation groove by applying one of a number of conventional casting methods such as the lost-wax casting method. Finally, any excess deposited mounting material can be removed and the stone fixed to the article of jewelry via the mounting material such that the mounting material of a completed article of jewelry is not visible when the stone is viewed from the upper portion thereof.

In a preferred embodiment of the present invention, the lost-wax casting method is utilized to deposit the mounting material (preferably the same metal used to form the carrying portion of the jewelry and most preferably gold) within the affixation groove of the stone. This method of casting preferably comprises the following steps: forming a wax model of the stone-receiving portion of the article of jewelry; mounting the stone to the model such that wax occupies at least a portion of the affixation groove; forming an investment about the wax mold and the stones; removing the wax from the investment by the application of heat; replacing the wax removed from the investment with a mounting material such that the mounting material occupies at least a portion of the affixation groove; and removing the investment from the stone and mounting material.

One aspect of the present invention improves upon the lost-wax casting method by using heat and pressure to aid in mounting each stone to the wax model prior to forming the investment. The heat and pressure ensure that the stone is properly positioned in the model and that wax of the model penetrates the affixation grooves. Stones securely mounted to and properly positioned on the wax model improve the quality of the resultant cast jewelry.

The methods of the present invention further improve over the prior art in that the only modification to the gem stone is to cut affixation grooves in the pavilion of the stone. U.S. Pat. No. 5,649,434 to Itzkowitz, for example, discloses an invisible setting for round diamonds which requires extensive modifications to the girdle of the stone prior to creation of the affixation grooves. Not only are such modifications to the stone expensive, some size, weight and brilliance of the stone are necessarily lost.

Variations of the preferred embodiment of the present invention focus on different ways of forming the affixation groove within a stone to be set in an article of jewelry. For example, one method of forming the affixation groove entails cutting the groove into a stone using a blade which is advanced toward and into the pavilion of the stone at an angle of 90° and then causing relative rotation between the stone and the blade whereby a generally annular groove is formed in the stone.

It is also possible to form first and second linear affixation grooves on the pavilion of a stone in order to secure the stone to the settings in two locations. The affixation groove can be defined between two substantially symmetric adjoining walls. In certain circumstances, the affixation groove can also be defined between two opposing side walls and an adjoining bottom wall.

Numerous other advantages and features of the present invention will become apparent to those of ordinary skill in the art from the following detailed description of the invention, from the claims and from the accompanying drawings.

BRIEF DESCRIPTION OF THE DRAWINGS

The preferred embodiments of the present invention will be described below with reference to the accompanying drawings wherein like numerals represent like structures and wherein.

DESCRIPTION OF THE PREFERRED EMBODIMENTS

Figure 1:
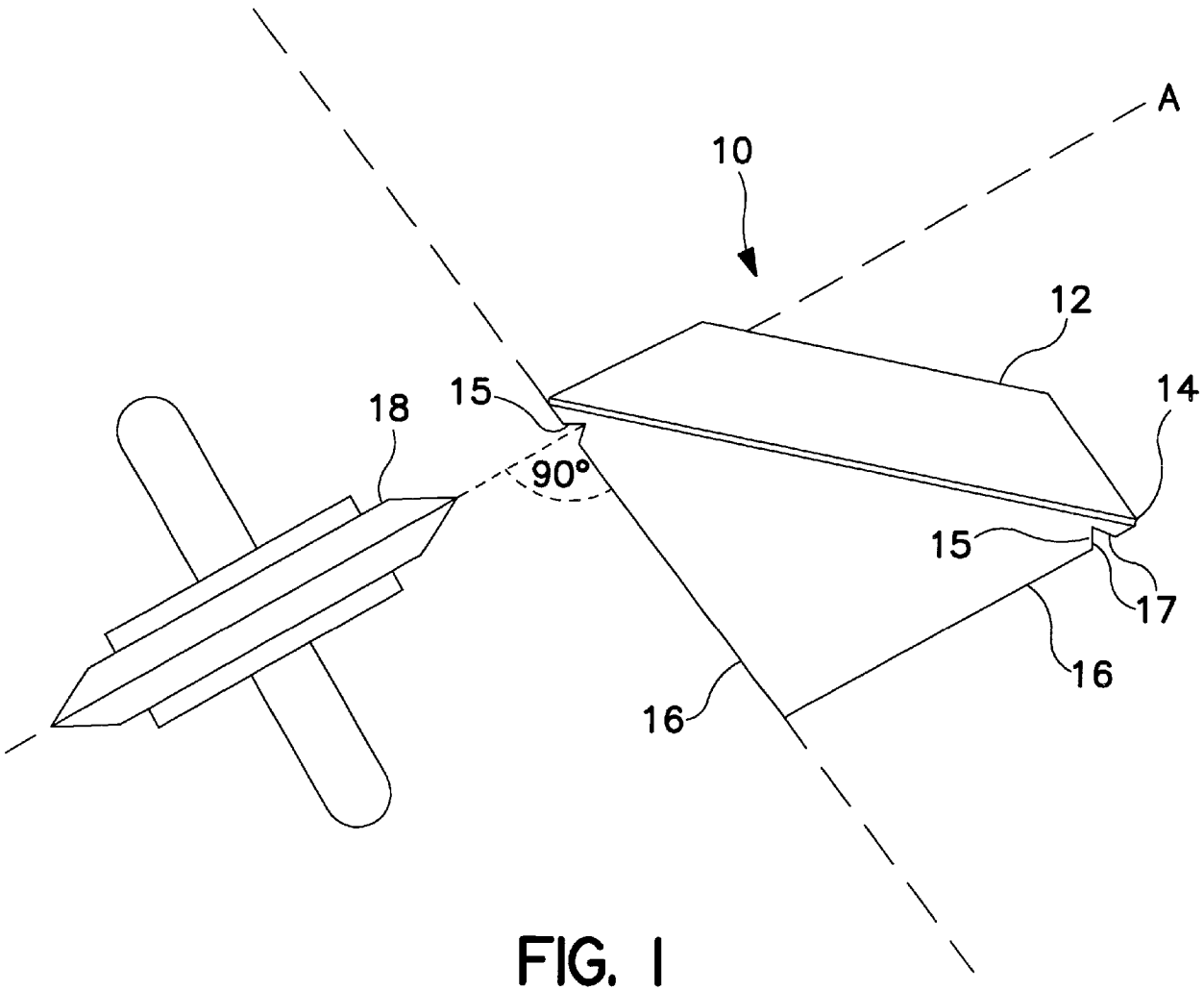
FIG. 1 is a schematic representation of a stone having two preferred affixation grooves formed therein.

A first preferred method embodiment of the present invention will be described below with joint reference to FIGS. 1 through 14*b*. As shown in FIG. 1, a first method step of the invention entails forming the affixation grooves 15 within the lower pavilion portion 16 of a stone 10. As illustrated therein, stone 10 further includes an upper table portion 12 and an enlarged girdle 14 disposed between table 12 and pavilion 16 such that pavilion 16 is hidden from view when stone 10 is viewed from above. Similarly, grooves 15, which are each defined between a pair of walls 17, are hidden from view under such conditions.

In a preferred embodiment, grooves 15 are each defined between symmetric adjoining walls 17 which are preferably formed with cutting blade 18. As shown, cutting blade 18 can be used to form grooves 15 by rotating blade 18 and advancing it along axis A until it contacts pavilion 16. Since axis A is oriented perpendicular to the surface of pavilion 16, blade 18 forms symmetric walls 17 of grooves 15. Whereas FIG. 1 depicts a pair of linear affixation grooves 15 having been cut into stone 10, a single affixation groove can be formed in the lower pavilion of stone 10. This is preferably accomplished by moving blade 18 into stone 10 and causing relative rotation between blade 18 and stone 10 until a generally annular groove 15 is formed.

Regardless of the number of grooves 15, however, it is preferred to form symmetric grooves within pavilion 16 of stone 10 because doing so requires a minimum of effort. Moreover, forming one or more symmetric grooves 15 ensures maximum brilliance of the stone because the setting which is to be formed therein is as small as possible while the stone itself remains as large as possible. Naturally, this also reduces costs by minimizing the amount of mounting material necessary to form the desired setting, i.e., to set the stone in an article of jewelry.

Figure 2:
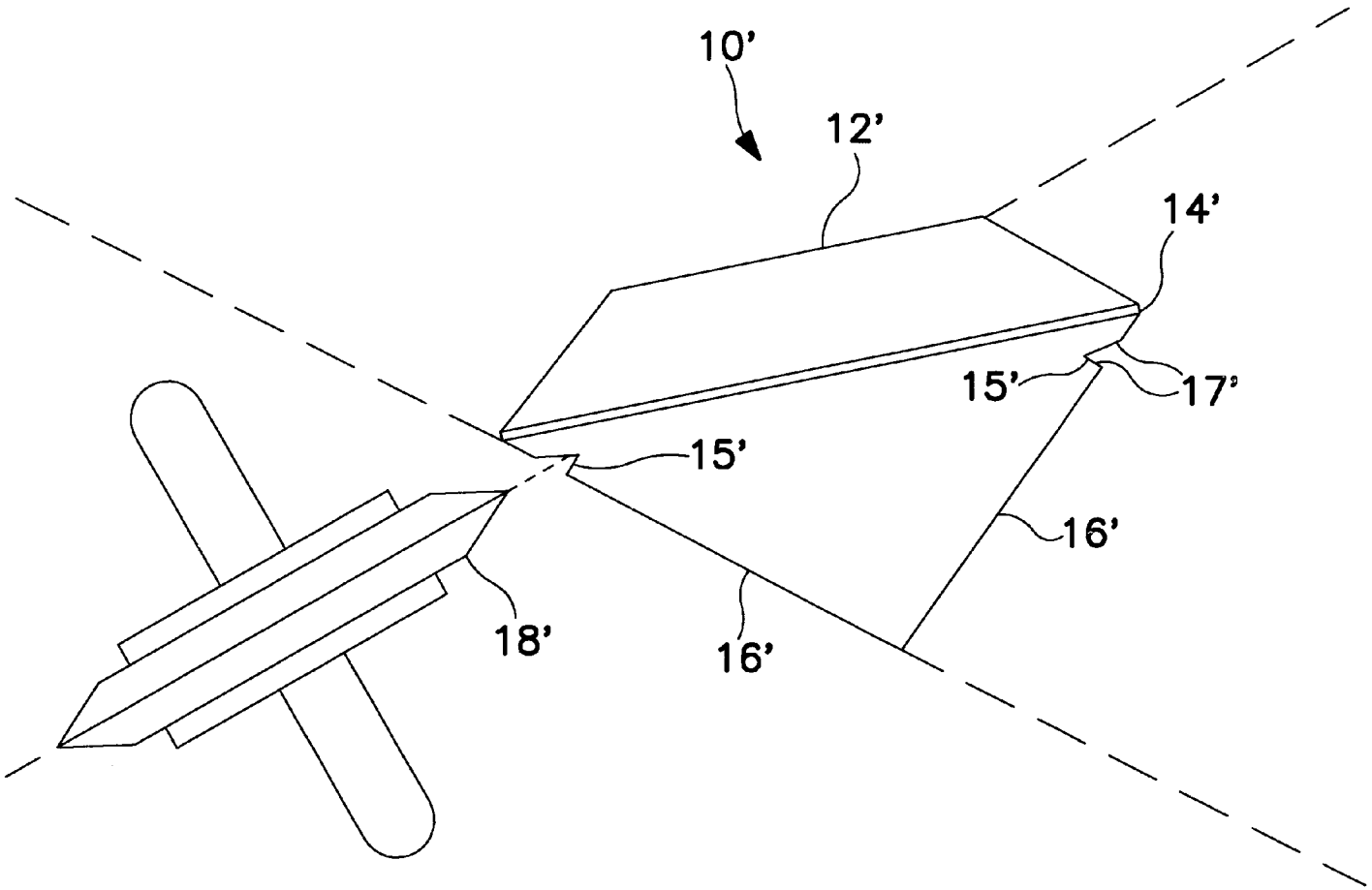
FIG. 2 is a schematic representation of another stone having two alternative affixation grooves formed therein.

FIG. 2 illustrates a stone 10' of the same general nature as shown in FIG. 1. Affixation grooves 15', however, are slightly different from grooves 15 of FIG. 1. In particular, it will be appreciated that groove walls 17' which define affixation grooves 15' are not symmetric and, therefore, are not of equal height. It will be appreciated that grooves 15' have been formed by moving cutting blade 18' along an axis A' which is not perpendicular to the surface of converging pavilion 16'. It should be noted that, while affixation grooves 15' are effective elements of the present invention, grooves 15 of FIG. 1 are preferred to grooves 15' of FIG. 2. This is largely due to the fact that the extended length of one of groove walls 17' yields a concomitant reduction in the brilliance of stone 10'. Additionally, production of asymmetric grooves 15' requires the removal of additional material from stone 10' and requires more than a minimal amount of mounting material to fill grooves 15'. For all of these reasons, grooves 15 of FIG. 1 are preferred to grooves 15' of FIG. 2.

Figure 2A:
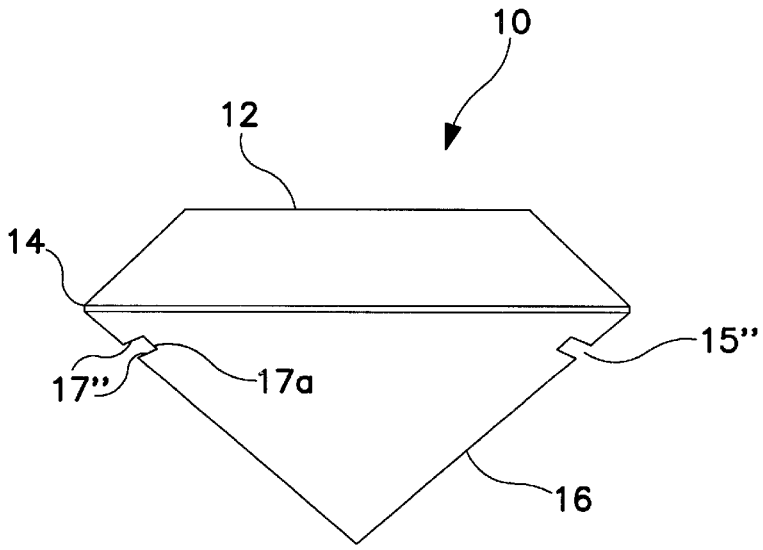
FIG. 2A is a schematic representation of another stone having two alternative affixation grooves formed therein.
Figure 3:
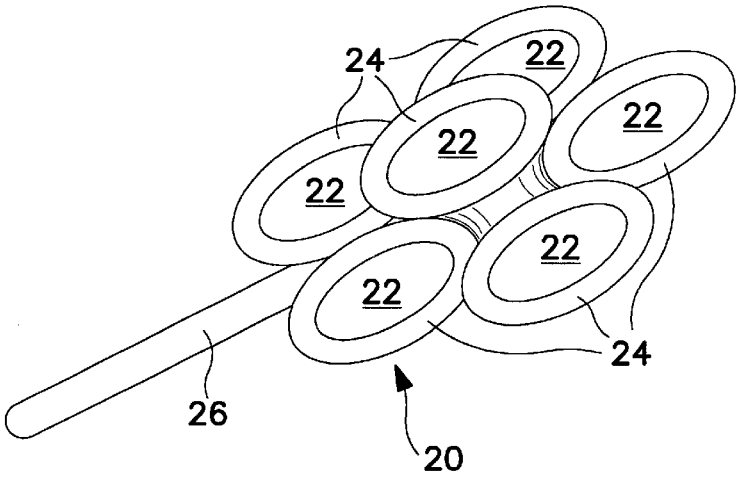
FIG. 3 is a silver model utilized in the lost-wax casting method used in the present invention.

FIG. 2A illustrates a further alternative configuration of an affixation groove. In this embodiment, affixation groove 15" is defined by groove walls 17" and bottom wall 17*a*. A square or trapezoidal groove has the advantage of an increased volume which improves the security of the invisible setting by increasing the size and thus the strength of the mounting material which penetrates the groove. Secure mounting may be achieved with a square groove which penetrates a short distance into the pavilion 16 maintaining the brilliance of the stone 10. Such a groove may be formed by using a blade or wheel of appropriate cross-section. One disadvantage of the square groove 15" is that it requires more mounting material than the grooves 15, 15' illustrated in FIGS. 1 and 2.

Figure 15:
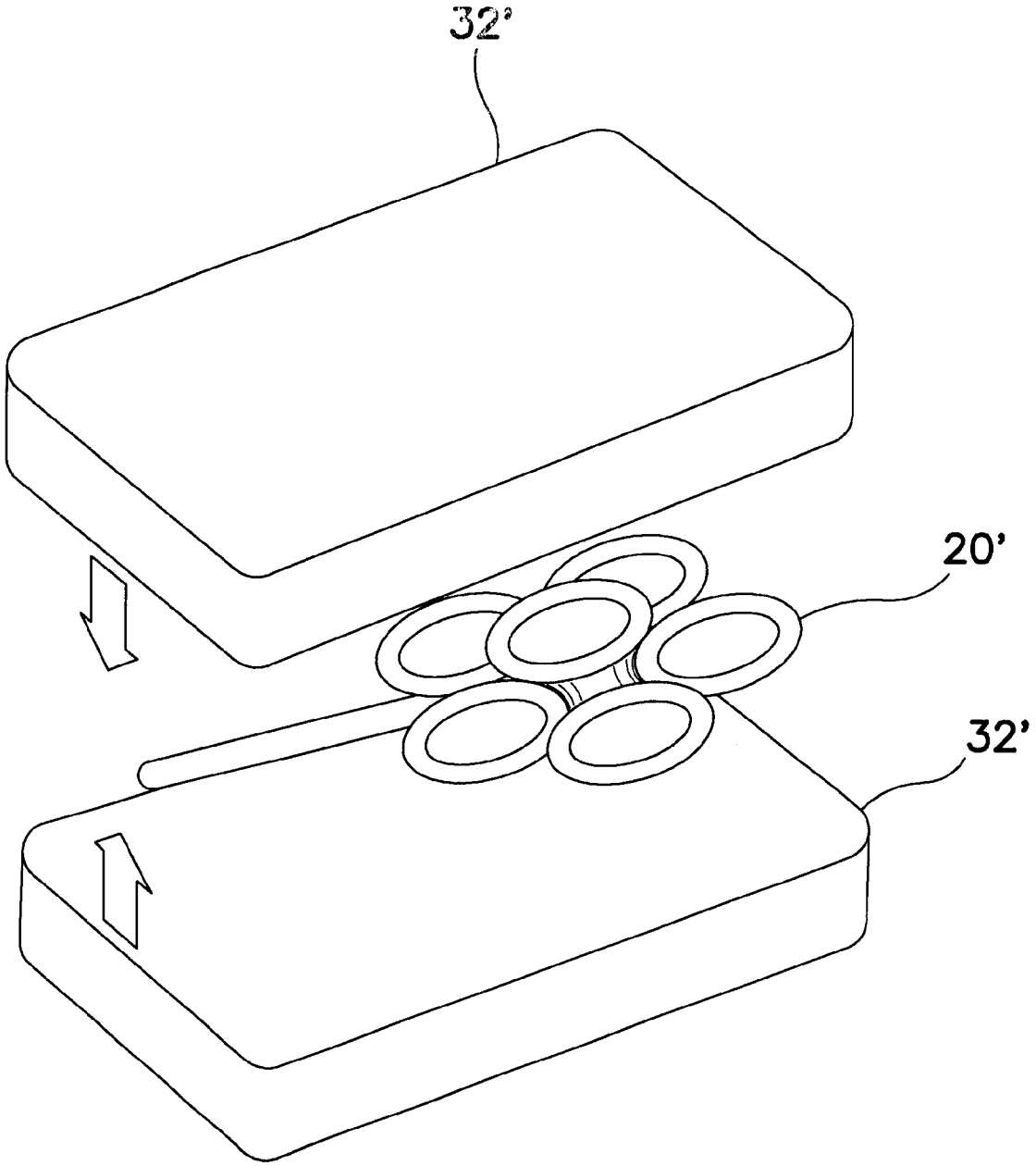
FIGS. 15 through 17 illustrate an alternate lost wax casting method which can be utilized in the present invention.

As seen in FIGS. 3 through 14*b*, the present invention, in part, preferably utilizes a first variation of the lost-wax casting method in order to form stone settings which can be used to affix a stone to an article of jewelry. It will be appreciated that the below-described method of producing such stone settings is highly efficient, in part, due to the fact that the stone settings can be formed in clusters rather than individually. It should also be appreciated that a second variation on the lost-wax casting method, which also yields acceptable end products, is also compatible with the present invention and will be described below with respect to FIGS. 15–17.

In the first variation of the lost-wax casting method, a silver model 20 is provided for receiving a cluster of stones which have been pre-cut as described above. Each silver model is preferably designed to receive a plurality of pre-cut stones within regions 22 such that lips 24 extends into the affixation grooves of the stones. Each silver model 20 is also provided with a branch portion 26 which serves multiple purposes as discussed below. Those of ordinary skill will readily appreciate that each silver model could be designed to receive either a single stone or an entire cluster of stones as desired.

Figure 4:
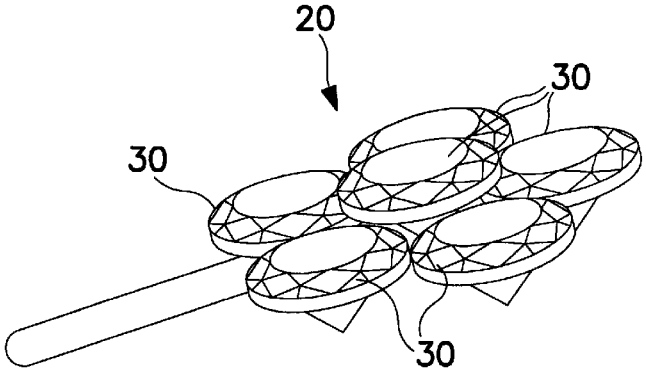
FIG. 4 illustrates the silver model of FIG. 3 with a cluster of stones received therein.

A second step of the lost wax casting method entails placing stones 30 within the respective receiving locations of silver model 20 as shown in FIG. 4.

Figure 5:
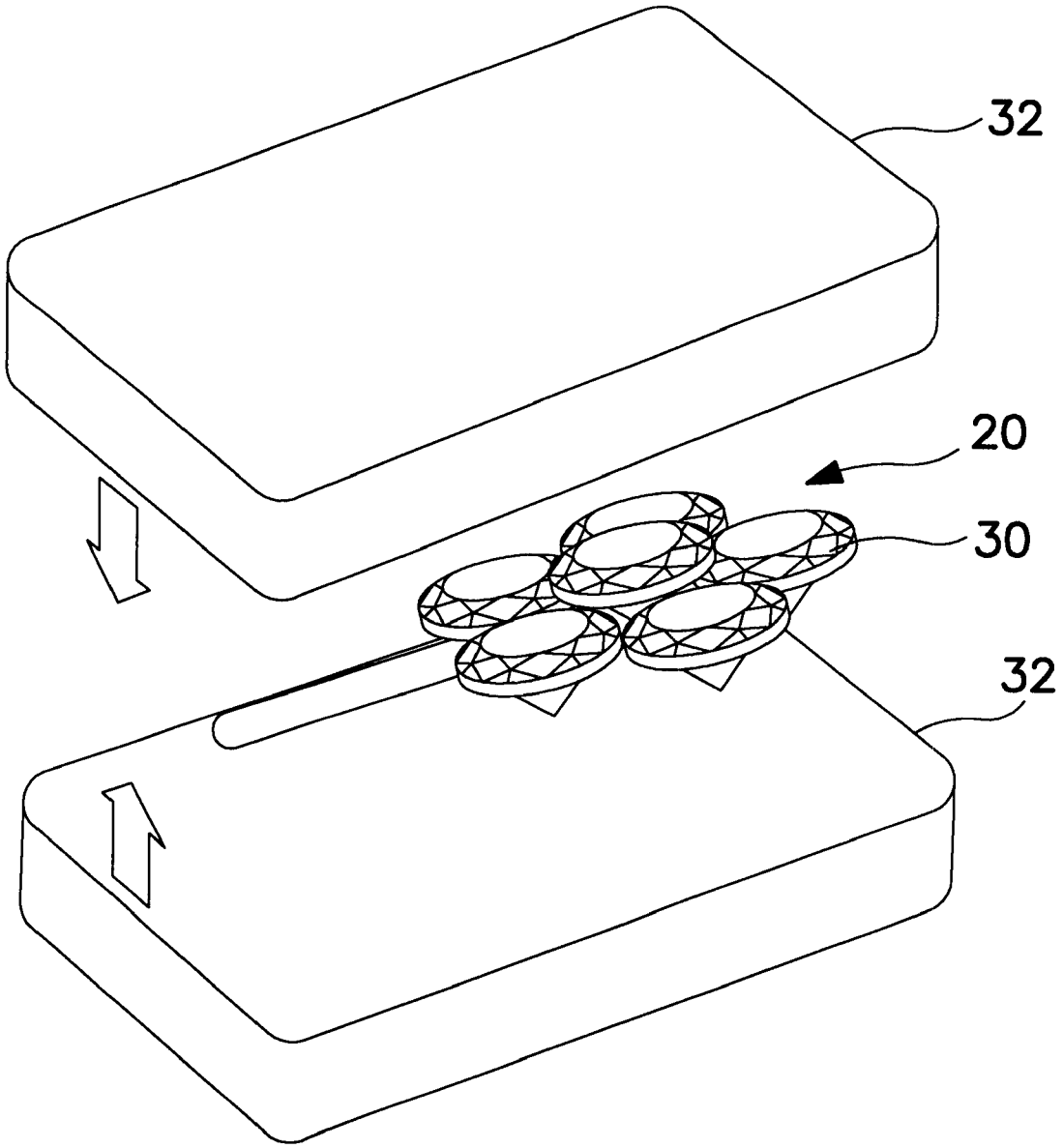
FIG. 5 illustrates the silver model and stones of FIG. 4 as they are placed into a rubber mold.
Figure 6:
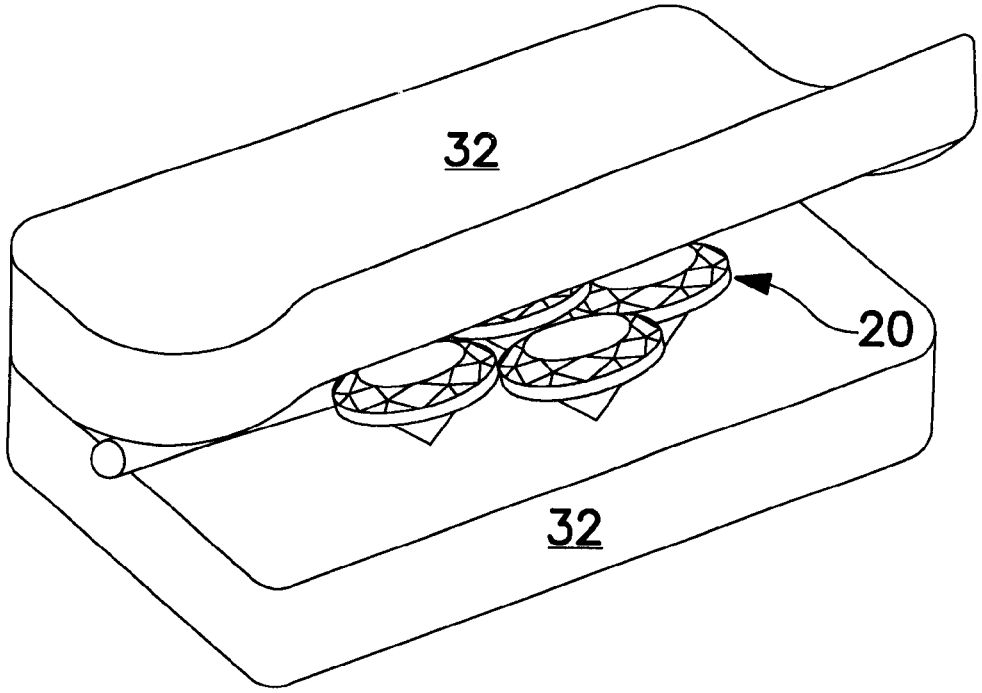
FIG. 6 illustrates removal of the silver model and stones from the newly formed rubber mold.
Figure 7:
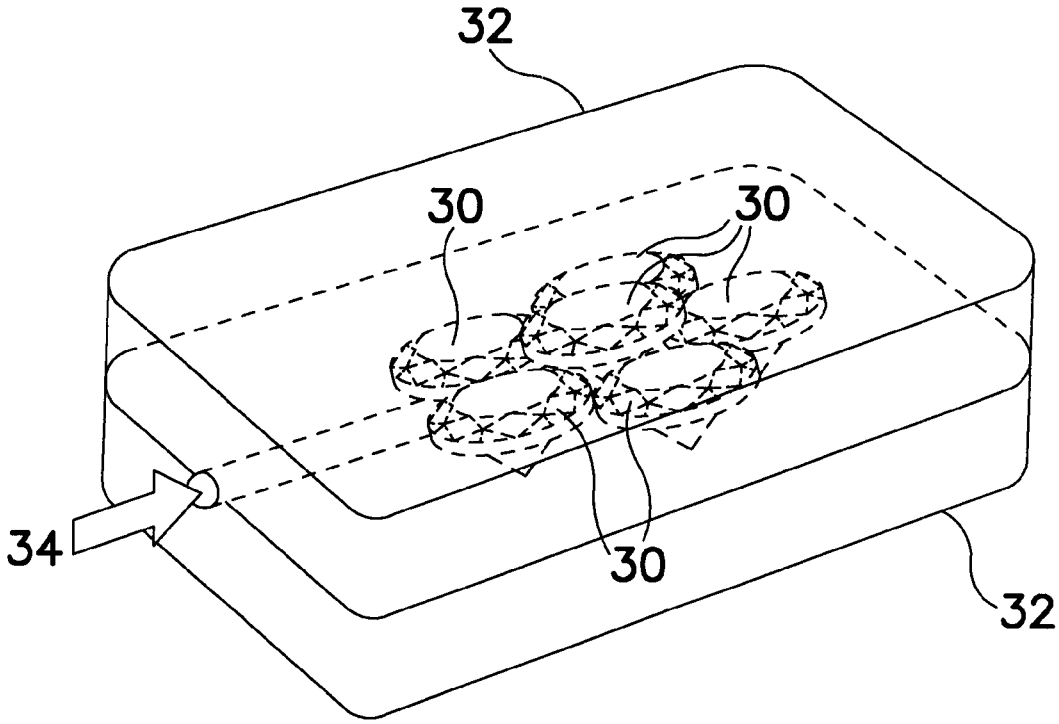
FIG. 7 shows the rubber mold of FIG. 6 with the cluster of stones replaced therein ready to receive liquid wax.
Figure 8:
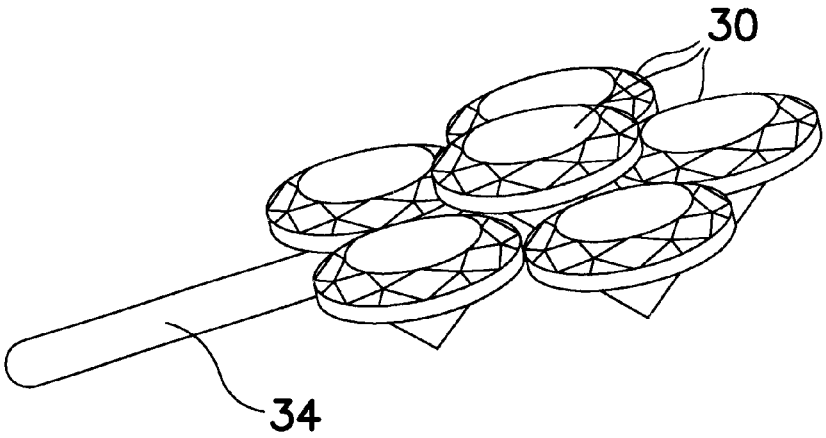
FIG. 8 shows the cluster of stones having been set in solidified wax.

An additional step entails placing the silver model, with stones affixed thereto, into a two-part rubber mold 32 as shown in FIG. 5. Once the desired impression of silver model 20 and stones 30 is formed in mold 32, mold 32 can be separated and the silver model removed therefrom. This is illustrated in FIG. 6. Upon the removal of silver model 20 from rubber mold 32, stones 30 are preferably removed from silver model and replaced into the respective locations of mold 32. It will be appreciated that, at this point, branch portion 26 of silver model 20 has formed a passage, from one end of mold 32 toward and into the region surrounding stones 30. As shown in FIG. 7, this passage can be utilized to introduce molten wax into mold 32 in order to create a solidified wax branch 34 having the same shape as silver model 20 (see FIG. 8).

Figure 9:
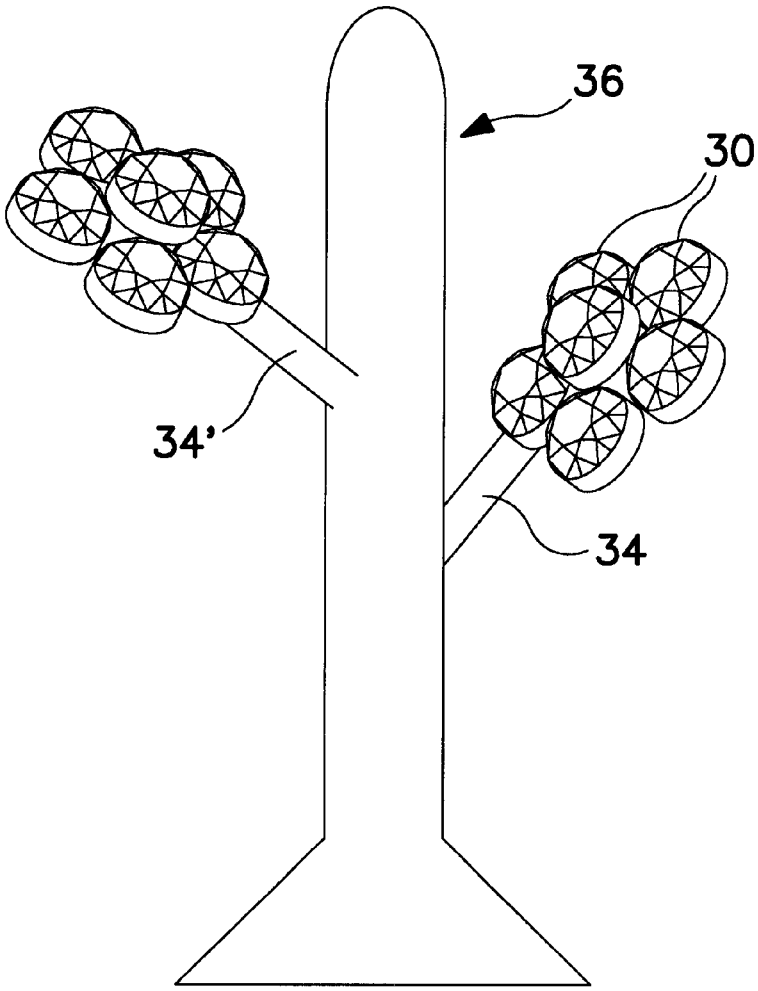
FIG. 9 shows a plurality of stone clusters received within a solid wax tree.
Figure 10:
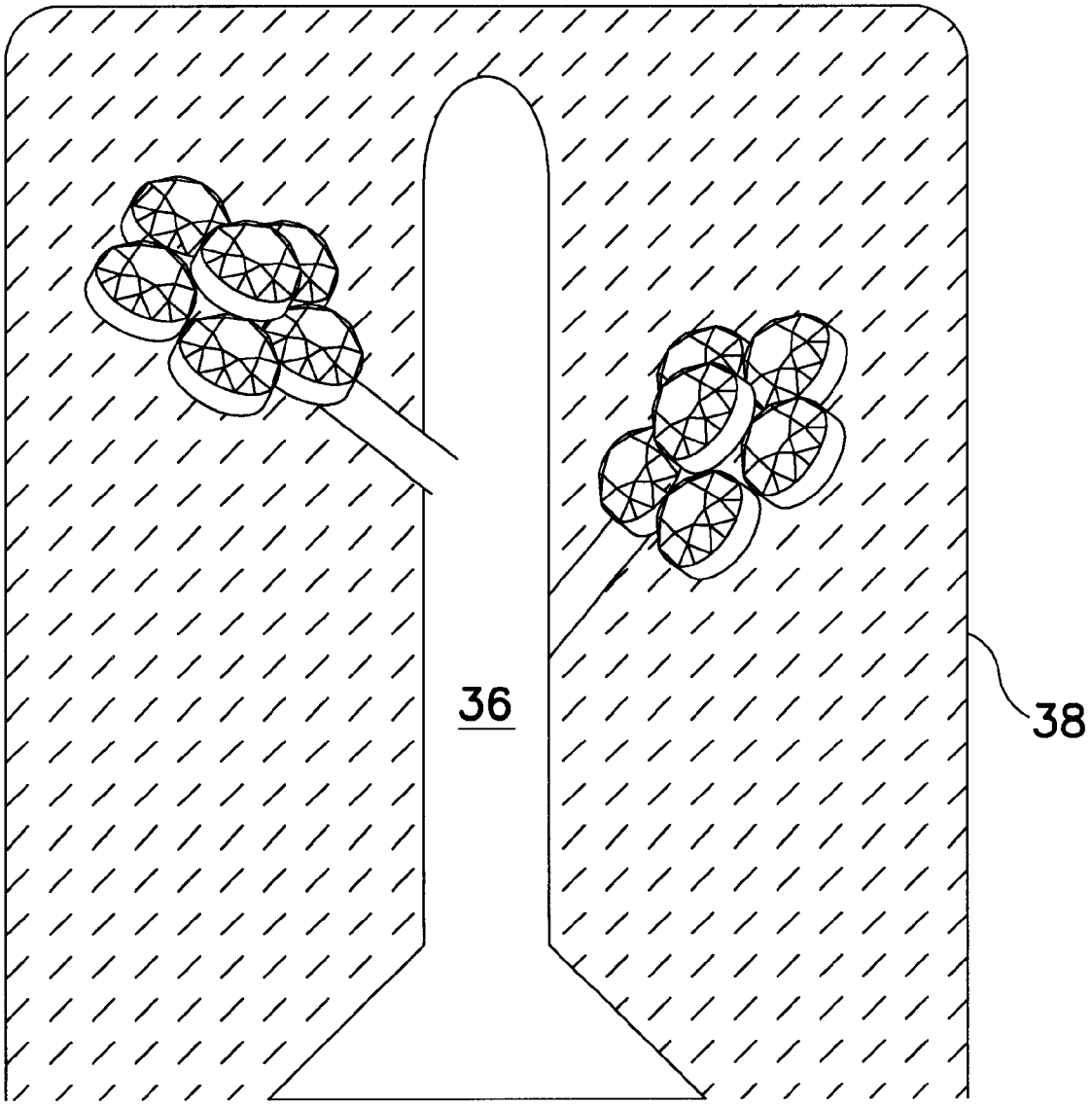
FIG. 10 illustrates the solid wax tree of FIG. 9 received within an investment.
Figure 11:
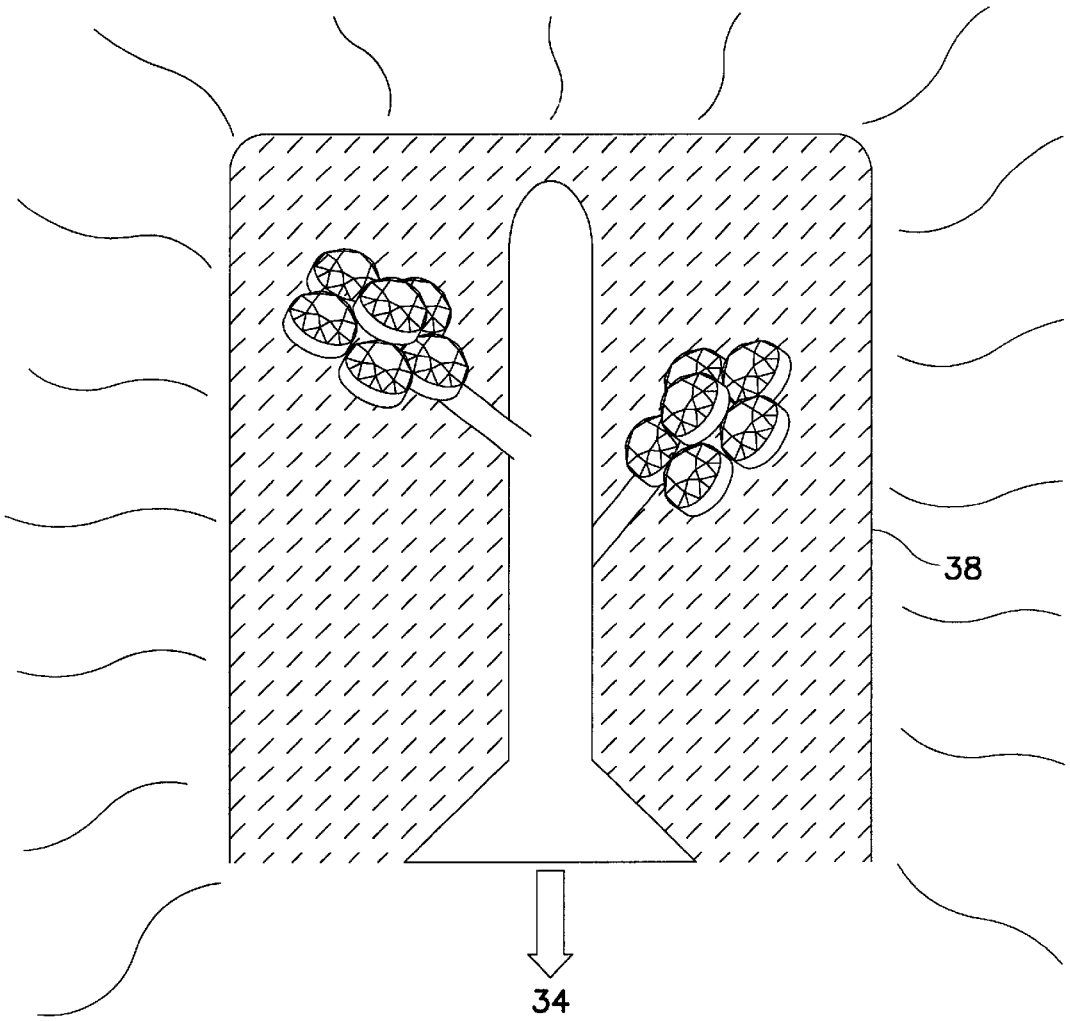
FIG. 11 illustrates the step of heating the investment to remove the liquified wax therefrom.
Figure 12:
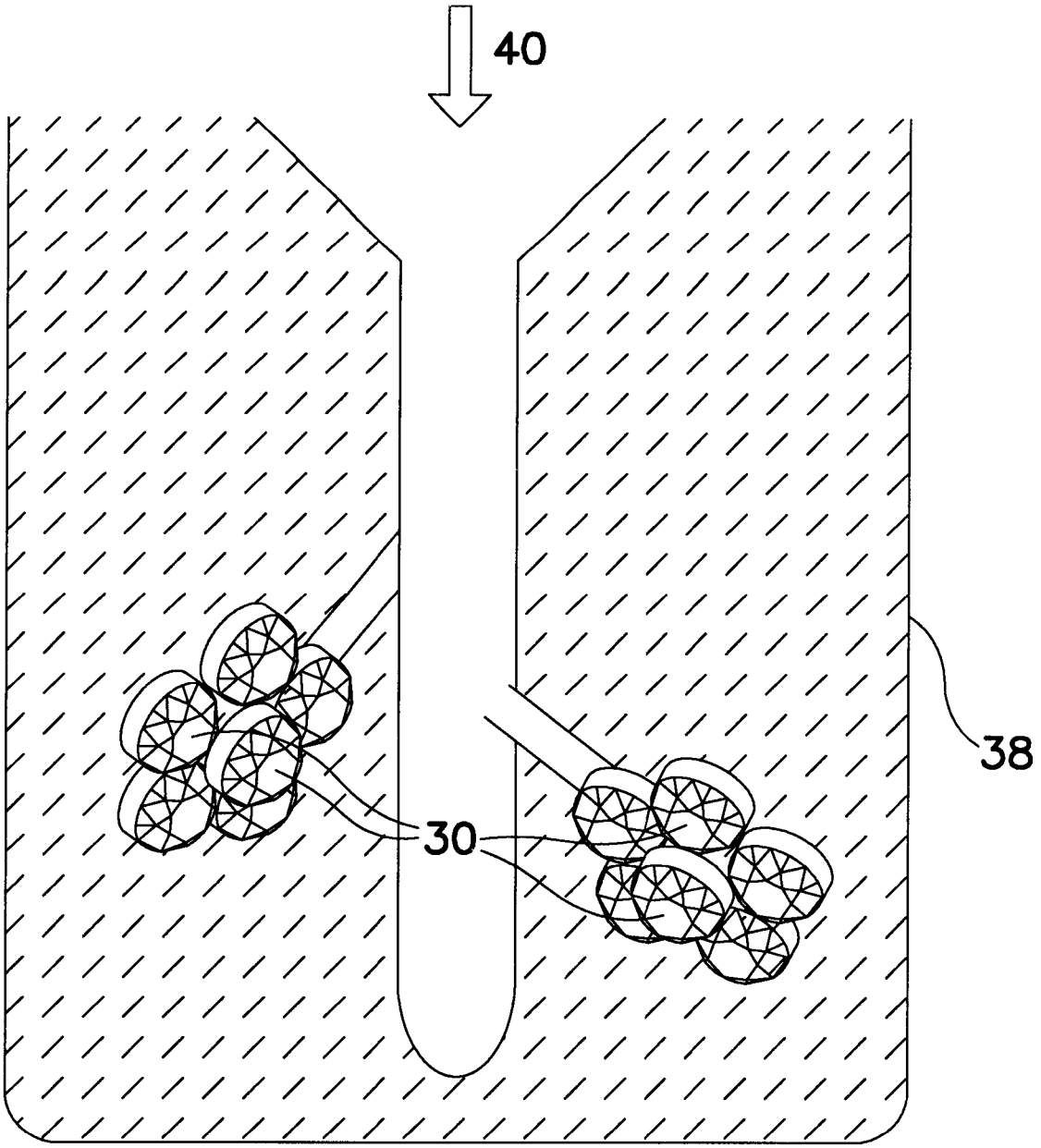
FIG. 12 illustrates the step of pouring liquid mounting material into the investment.

Once a plurality of wax branches 34 and 34' have been produced, they are affixed together to form a solid wax tree 36 as shown in FIG. 9. Then, wax tree 36 is surrounded by a heat-resistant investment as shown in FIG. 10. With the wax tree 36 and investment 38 in an upright position, the investment can be heated until the wax melts and drains out of investment 38 leaving stones 30 behind (see FIG. 11). Investment 38 can then be inverted and liquid mounting material introduced into the cavity previously occupied by wax tree 36. This is illustrated in FIG. 12. It will be appreciated that the preferred mounting material is the same metal as used in the carrying portion of the article of jewelry to which the stone is to be affixed.

Figure 13:
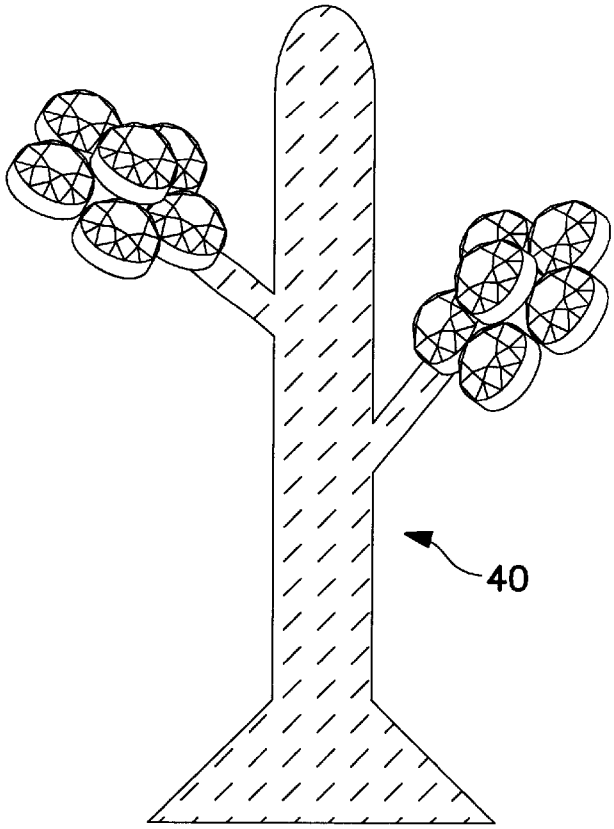
FIG. 13 shows a tree of solidified mounting material with a plurality of stone clusters disposed therein after the investment was removed therefrom.
Figure 14A:
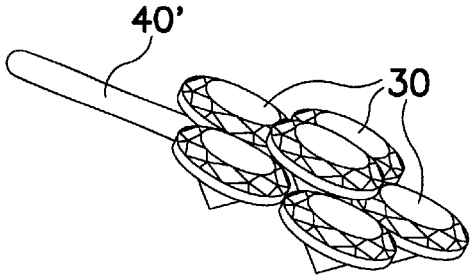
FIGS. 14*a* and 14*b* show the step of removing excess mounting material from the stone clusters.
Figure 14B:
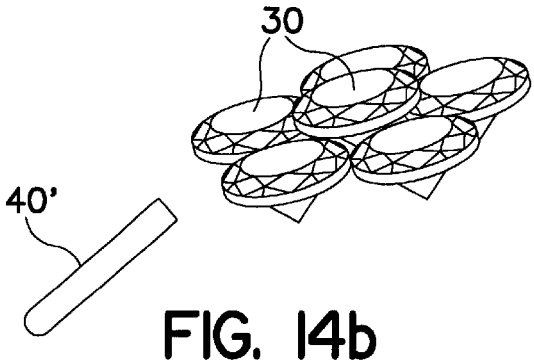

As shown in FIG. 13, once mounting material 40 has solidified, investment 38 can be removed leaving behind a tree of mounting material with clusters of stones 30 affixed thereto. At this point, each branch 40', with the cluster of stones 30, can be removed (see FIG. 14*a*) and the branch portion thereof separated from the clusters of stones 30 (see FIG. 14*b*) by cutting, by de-burring or by using one of the many other known methods. At this point, the stone settings or mounting members for affixing the clusters of stones 30 to the carrying member of an article of jewelry have been fully formed and the cluster of stones 30 can be affixed to the jewelry by one of a number of known methods such as soldering. Naturally, individual stones 10 can also be affixed to articles of jewelry by individually casting settings with the method described above.

Figure 16:
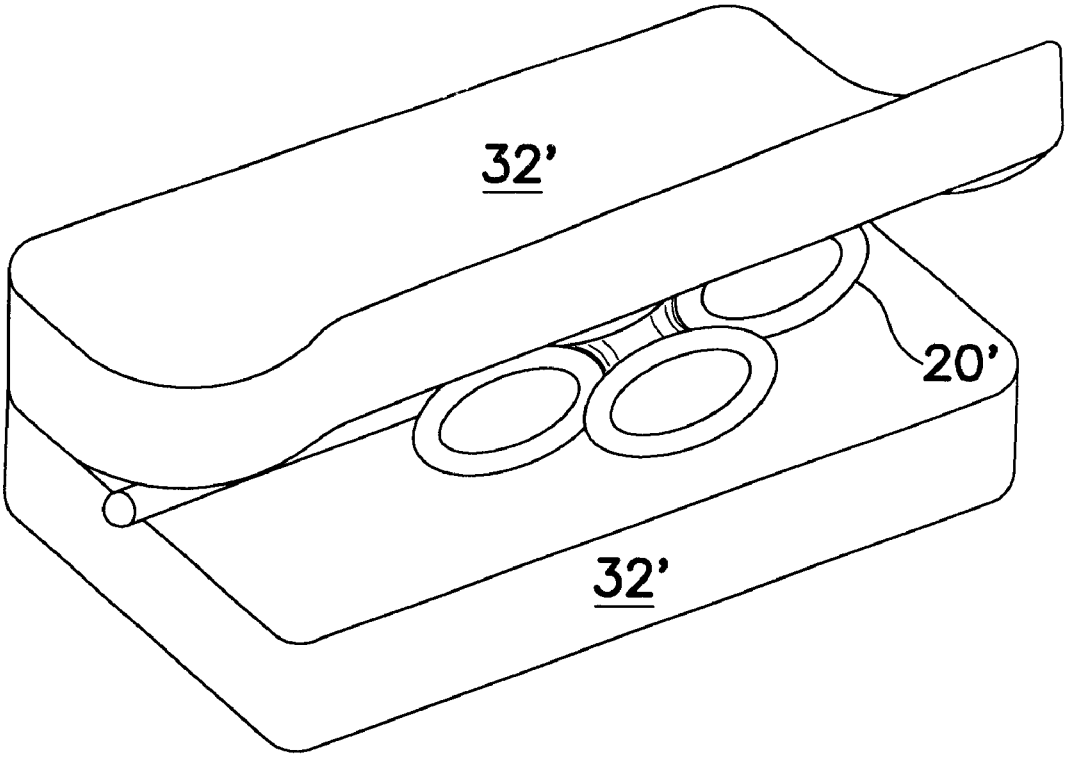

According to a particularly advantageous variation of the lost-wax casting method utilized with the present invention, a stone to be set into an article of jewelry is pre-cut as described above with respect to FIG. 1. Then, a silver model 20' (see FIG. 15), which is identical to silver model 20 of FIG. 4, is placed between the two portions of rubber mold 32' to create an impression of silver model 20' therein. As shown in FIG. 16, after an appropriate impression is formed in rubber mold 32', silver model 20' can be removed from the rubber mold.

Figure 17:
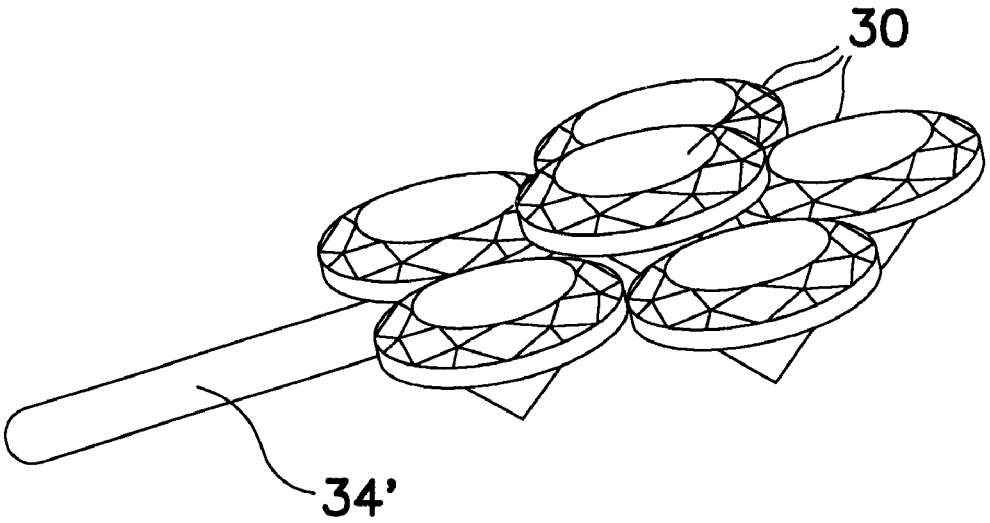
Figure 18:
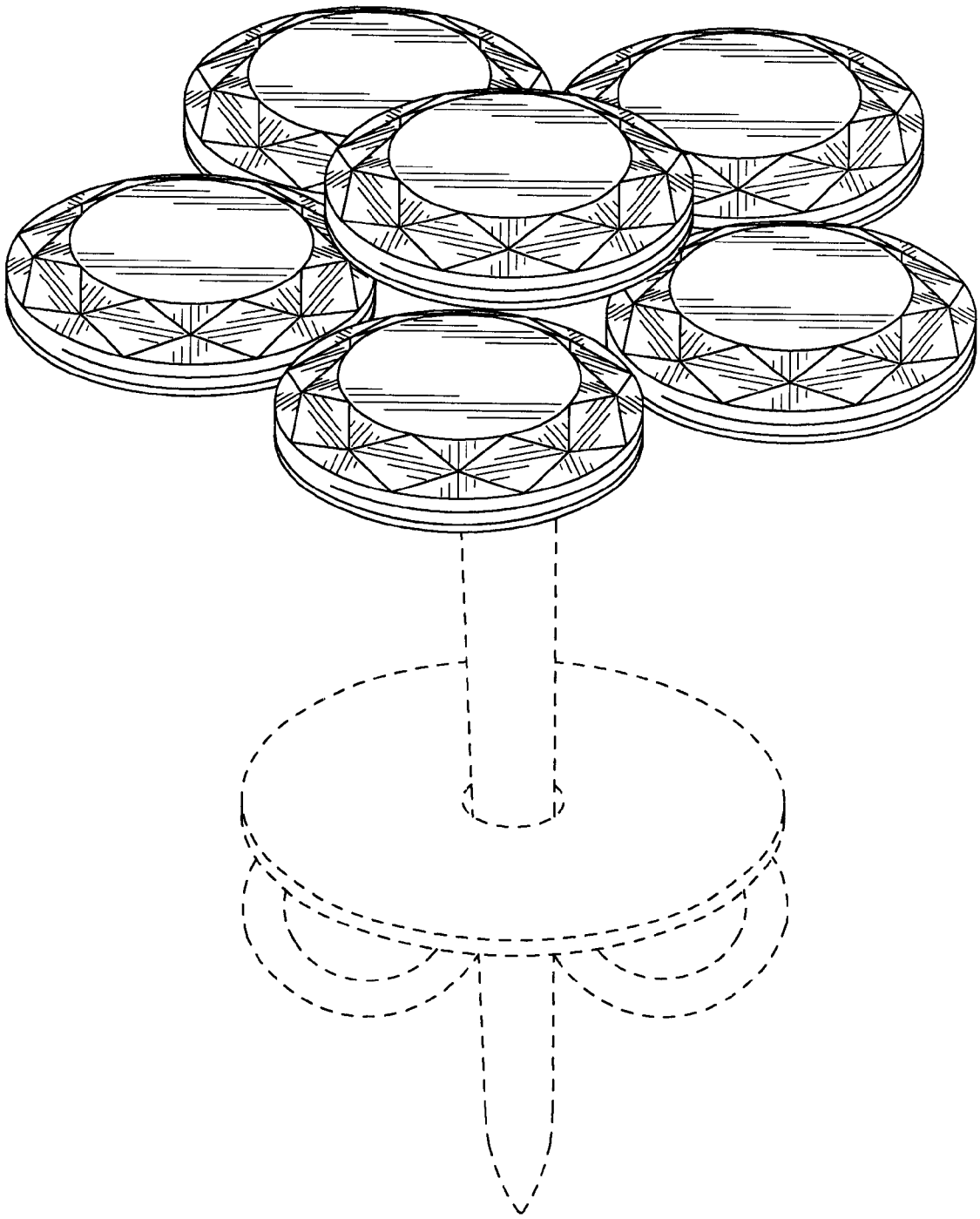
FIGS. 18 through 23 illustrate several examples of completed articles of jewelry produced using the present invention.
Figure 19:
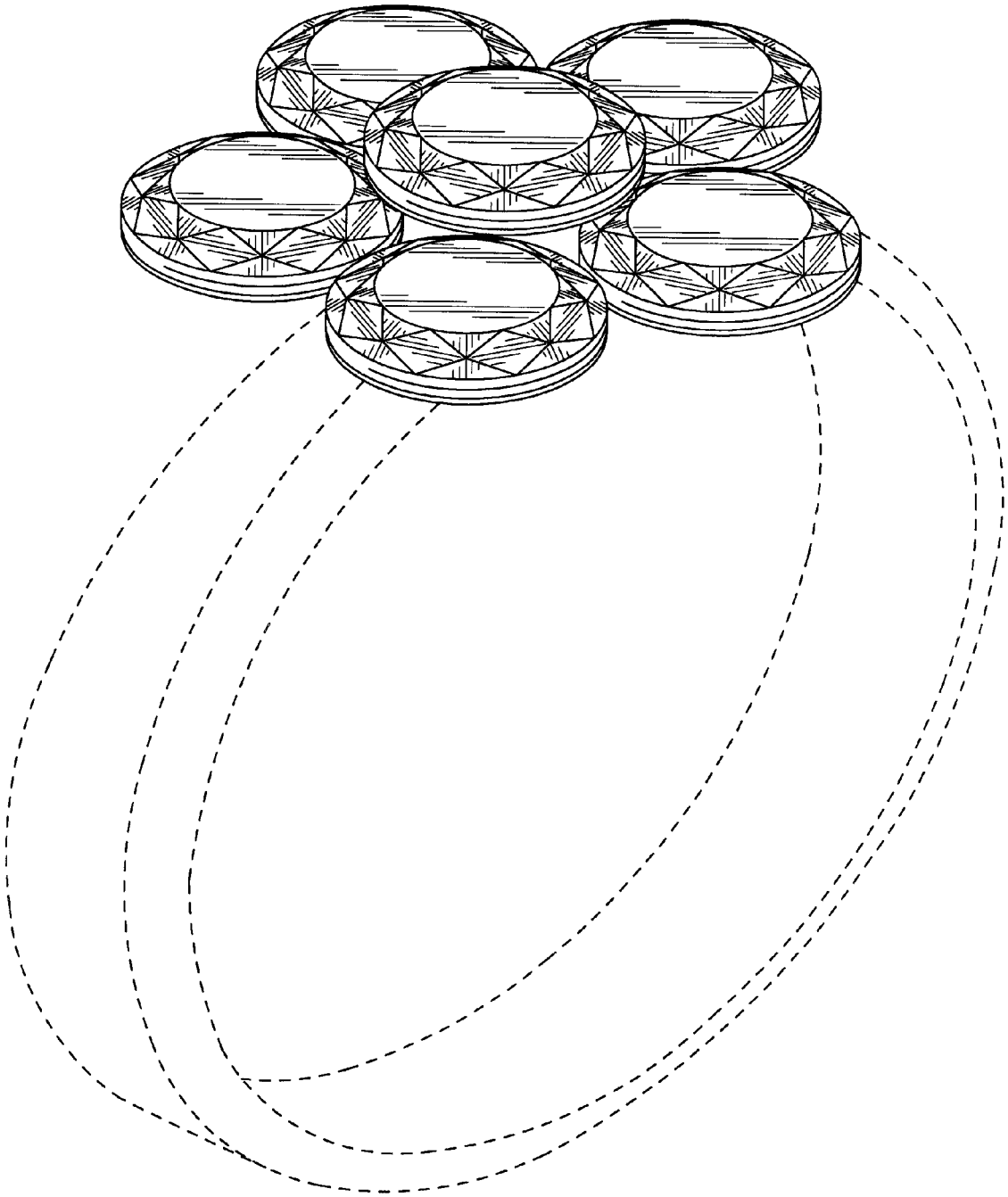
Figure 20:
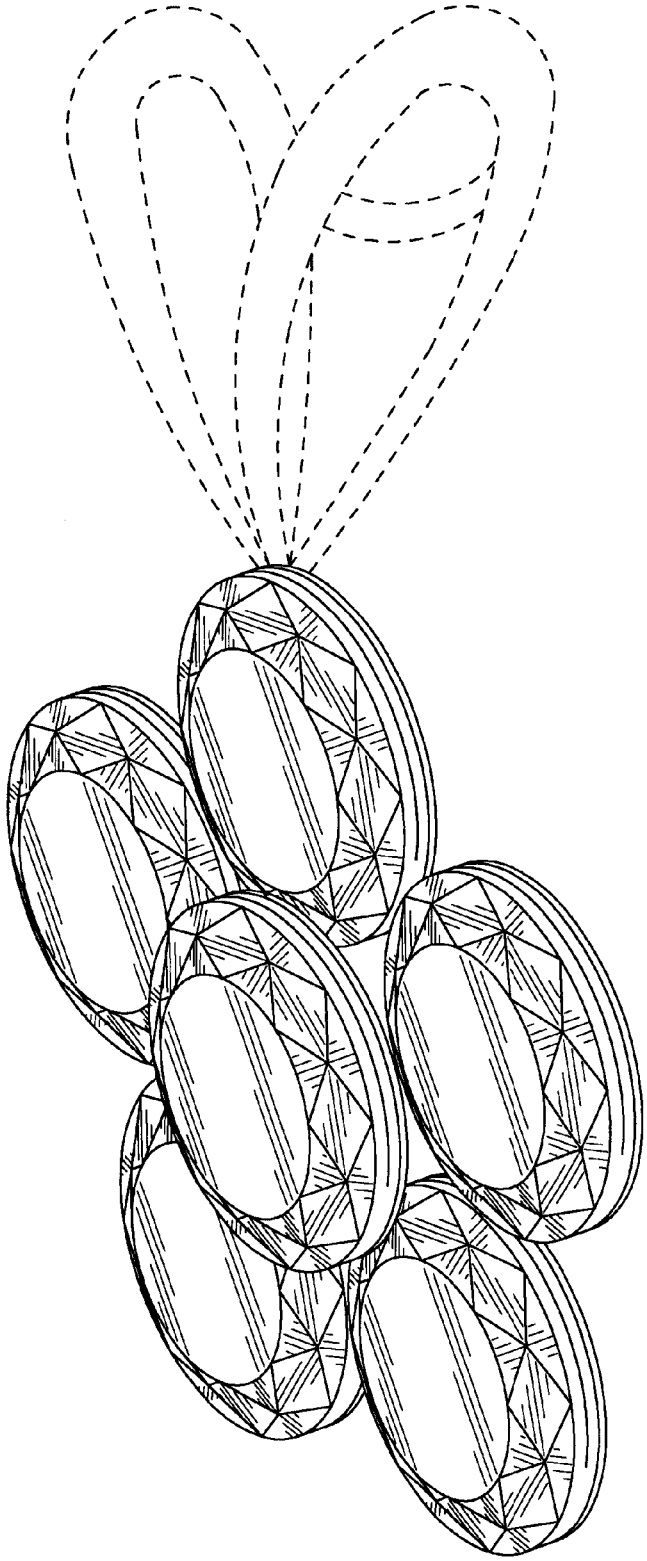
Figure 21:
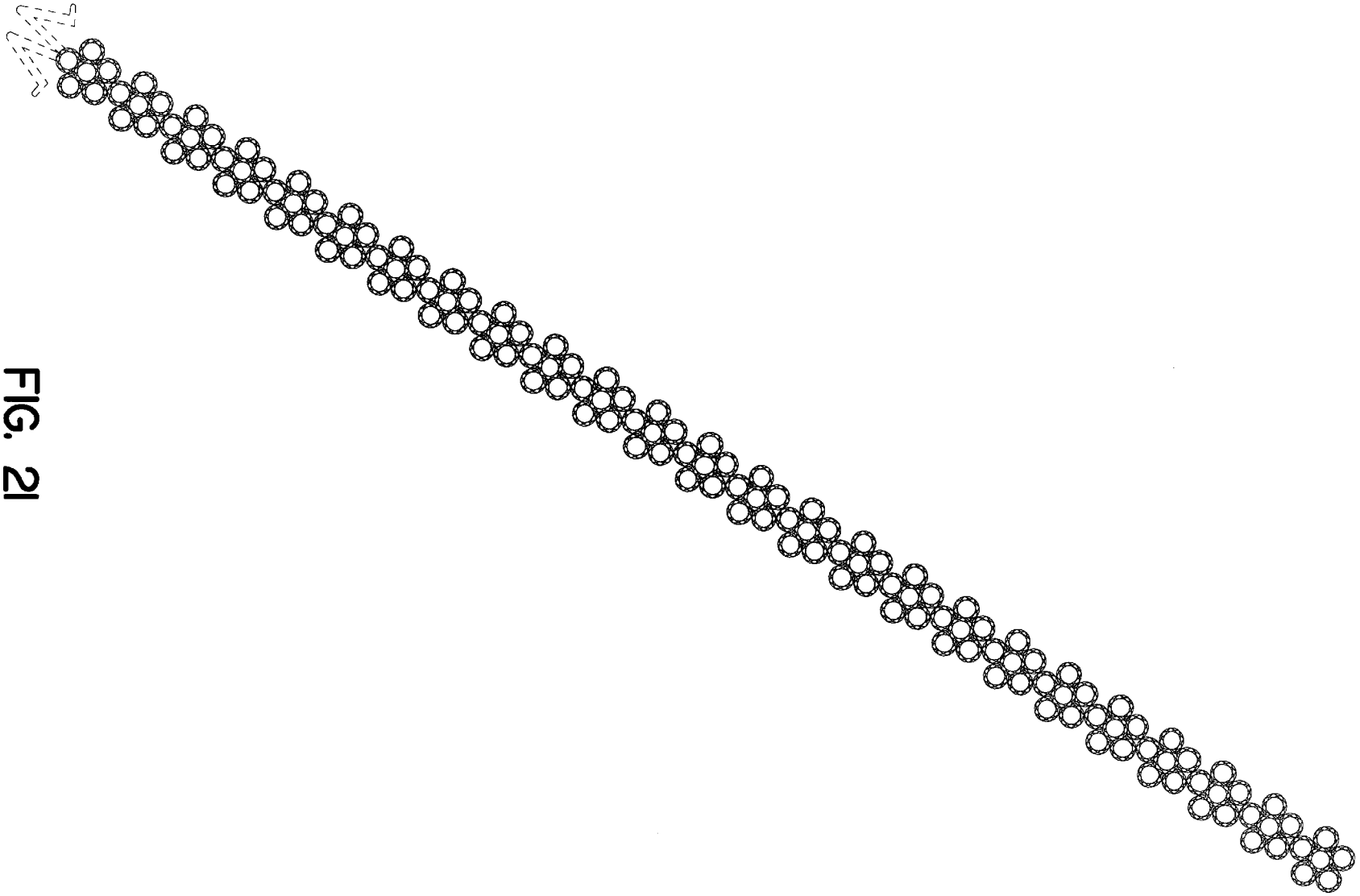
Figure 22A:
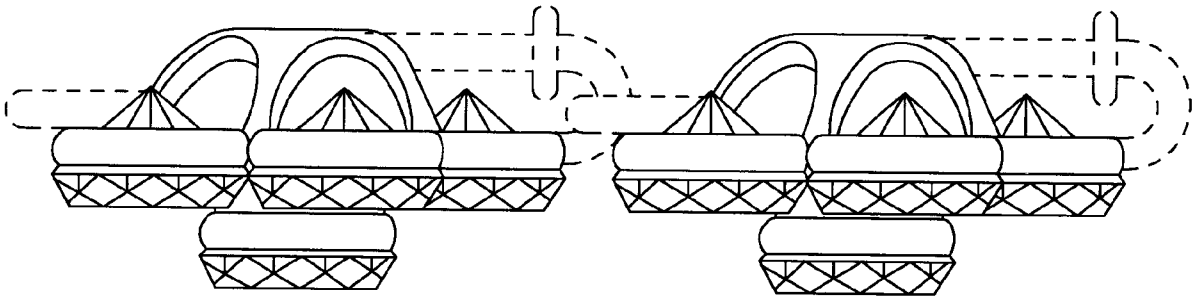
Figure 22B:
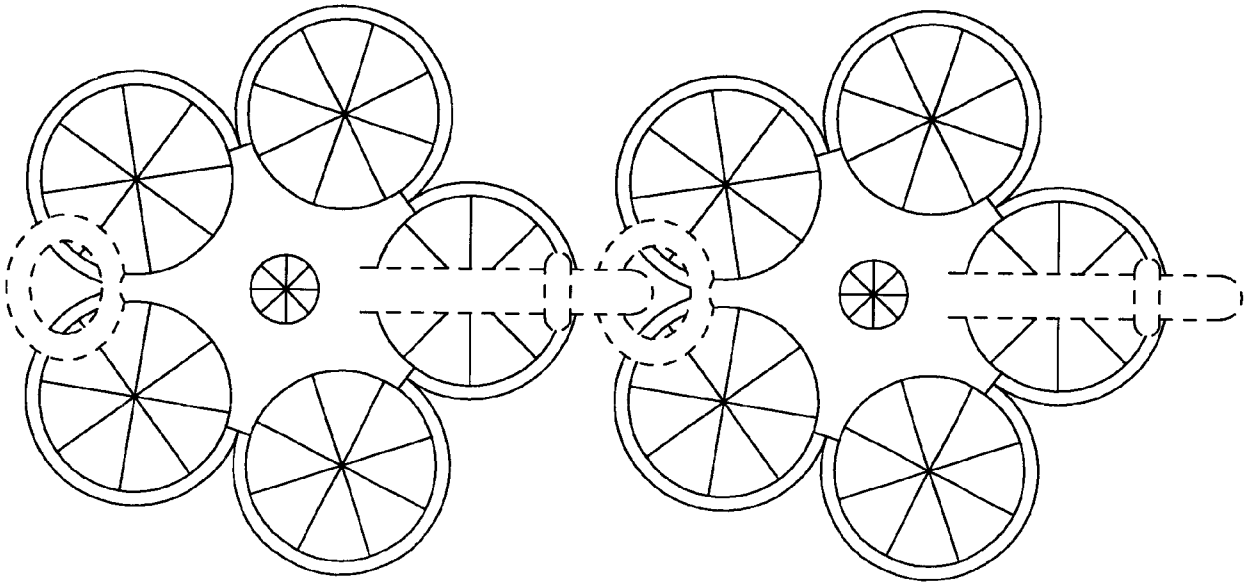
Figure 23:
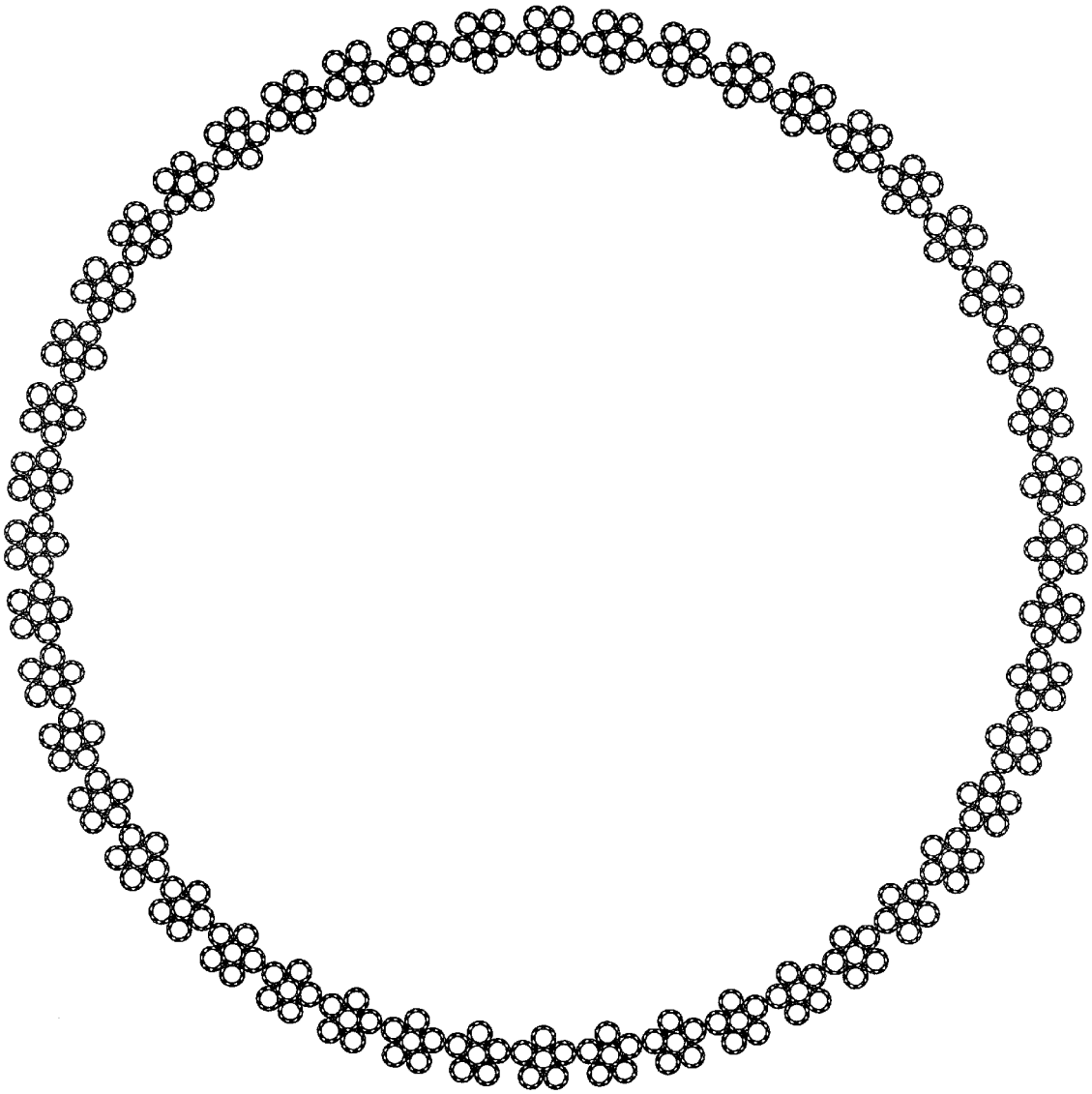

As shown in FIG. 17, this process results in the production of a wax model 34' into which stones 10 can be set. One difficulty experienced with mounting stones to the wax model is that the bond between the wax model and the stone is somewhat less secure than that achieved with the method described above and illustrated in FIGS. 3–14*a*. To create jewelry of commercially acceptable quality it is vital that the stones accurately maintain their position during the casting process. The method of the claimed invention includes a series of steps, illustrated in FIGS. 24–26, designed to improve the accuracy of the positioning and the security of the bond between the stone and the wax model prior to casting.

Figure 24:
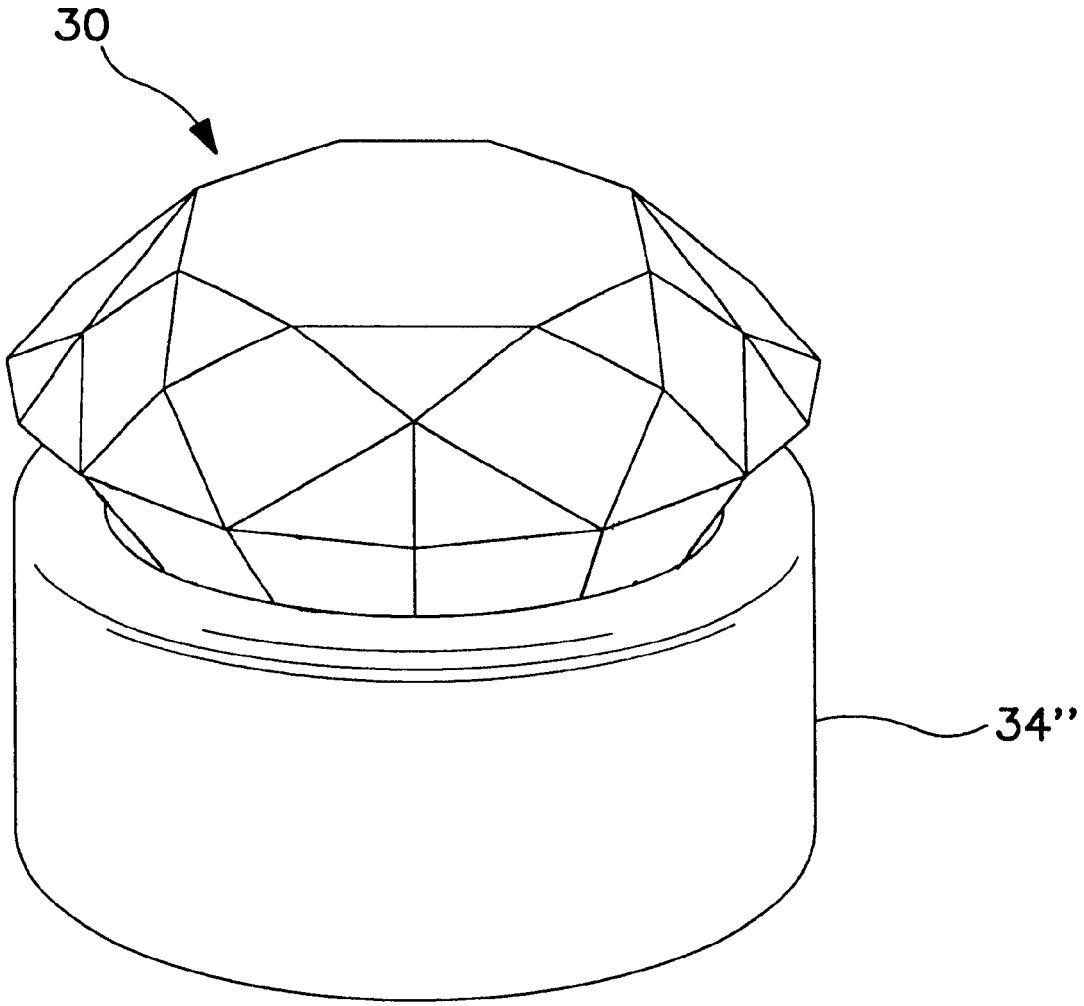
FIGS. 24 through 26 illustrate a method according to the present invention using heat and pressure to enhance the mounting of a stone to the wax model prior to investment.
Figure 25:
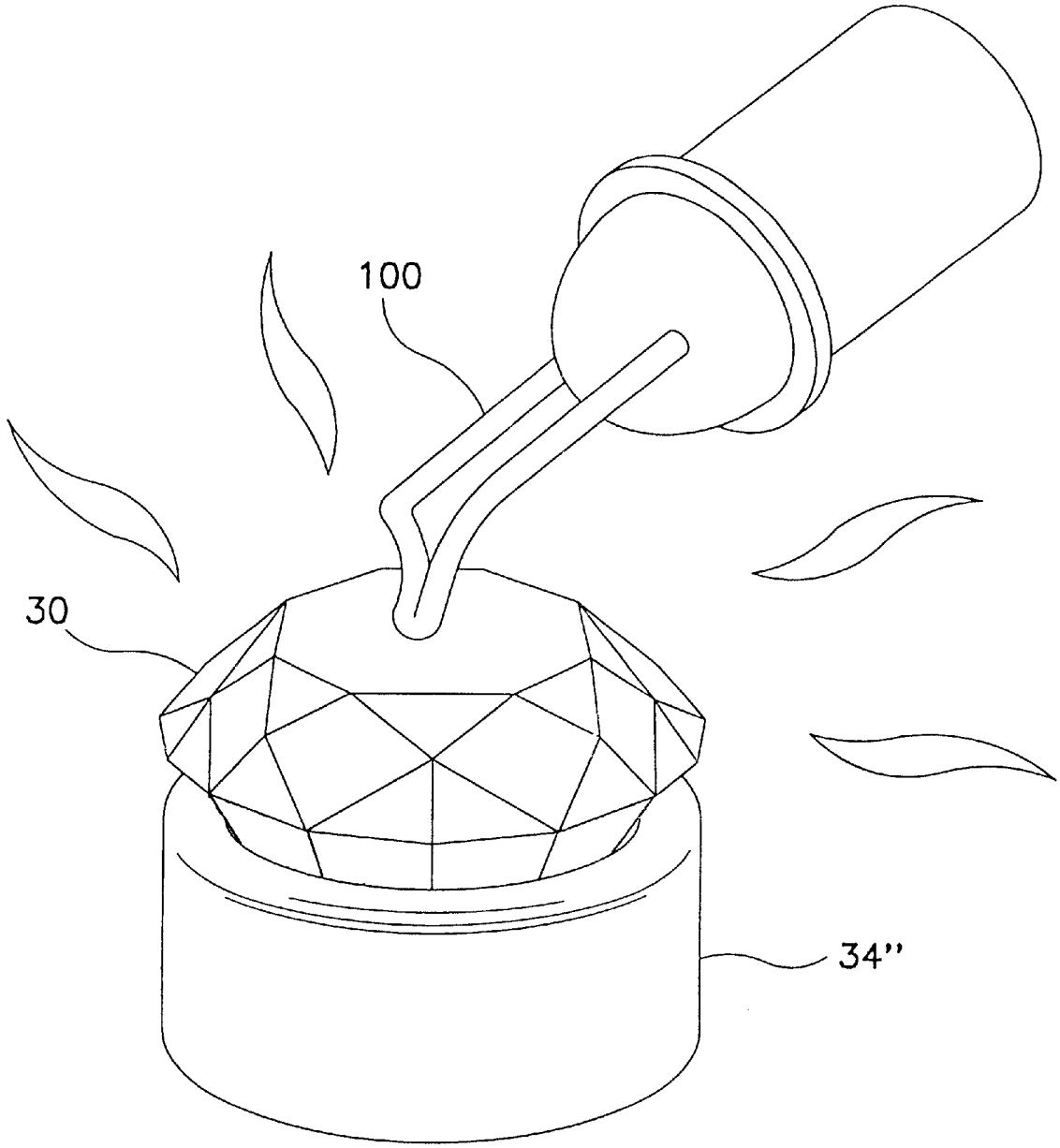
Figure 26:
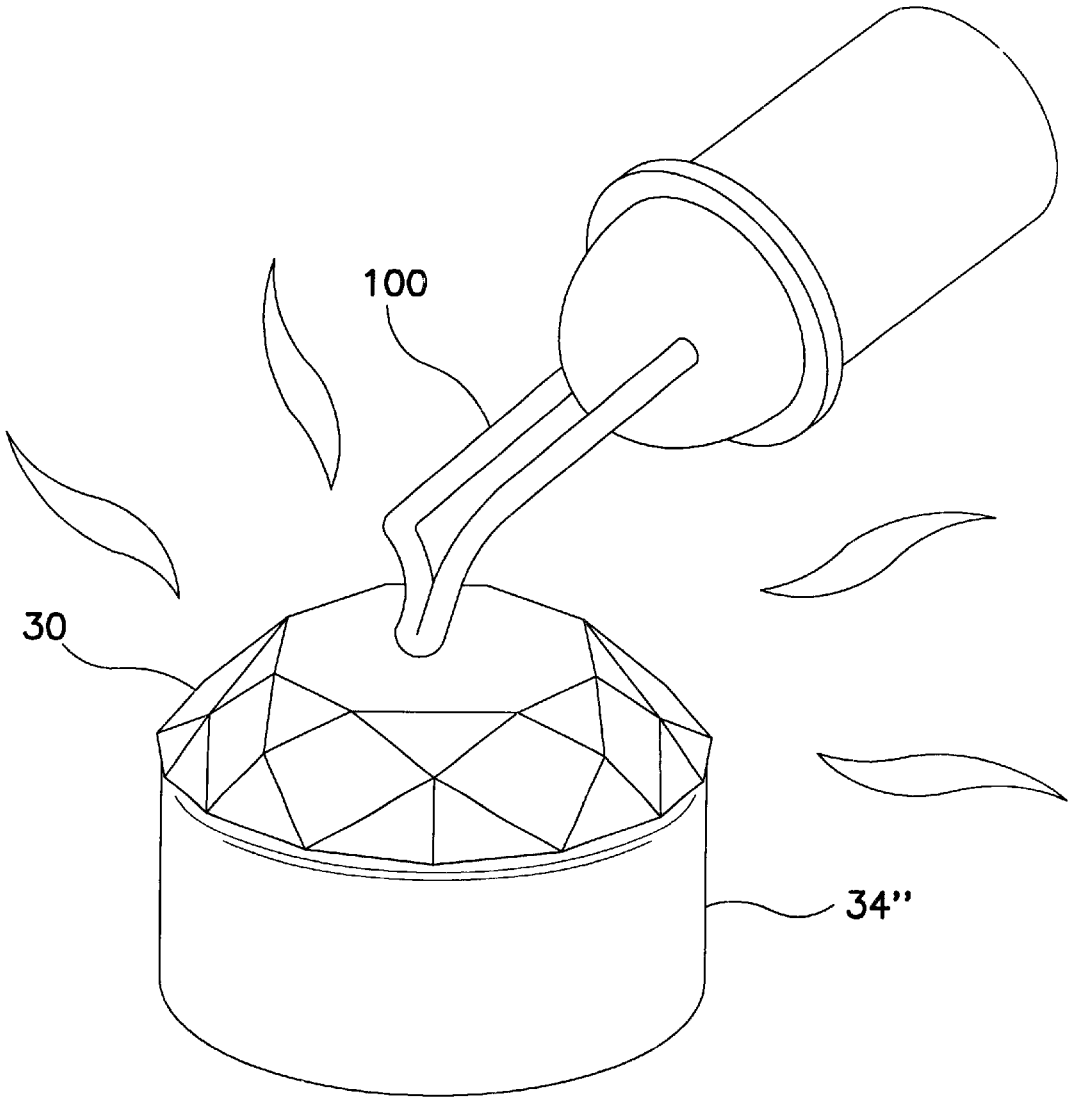

A stone 10 is placed on a wax model 34" of the stone-receiving portion of an article of jewelry (FIG. 24). A heating element 100 is then applied to the table 12 of the stone 10 for a duration of 5 to 30 seconds (FIG. 25). Application of heat and slight pressure from the heating element 100 partially melts the wax material of the model 34" allowing the wax to bond with the pavilion of the stone 10 and penetrate the affixation groove(s). In subsequent steps of the lost-wax process, the fact that the affixation grooves are occupied by wax makes it impossible for investment material to penetrate the grooves. Thus, when the wax is removed from the investment, mounting material is free to penetrate the now exposed affixation grooves. Heat treatment of the stones during mounting to the wax model not only reduces errors during the casting process but also provides an end product where the stones are more securely mounted to the jewelry.

This wax model with stones can then be used to form a wax tree such as the one described above with respect to FIG. 9. The remainder of this second variation of the casting process is identical to first variation described above and results in the production of either clusters of stones or individual stones with the desired settings.

It will be appreciated that the invention is particularly well suited to stones which have been previously formed into the general shape depicted in, for example, FIG. 1 (i.e., a stone having an upper table portion, a lower converging pavilion portion and an enlarged girdle therebetween). Nonetheless, the invention is also equally applicable to stones having many different shapes.

It will also be appreciated that the invention is wholly applicable to a wide variety of precious and semi-precious gemstones and that the invention achieves particularly stunning results when applied to clear or virtually clear gemstones such as diamonds.

Finally, it will be appreciated that the present invention also entails articles of jewelry produced in accordance with the methods shown and described herein. Several examples of such articles of jewelry are shown in FIGS. 18 through 23.

While the present invention has been described in connection with what are presently considered to be the most practical and preferred embodiments, it is to be understood that the invention is not limited to the disclosed embodiments and that it is intended to cover the various modifications and equivalent arrangements included within the spirit and scope of the appended claims.

What is claimed is:

1. A method for affixing a stone in a wax jewelry model of the type used in conjunction with the lost wax casting method, the stone including a table on one side thereof, a converging pavilion on an opposite side thereof and a girdle therebetween, said pavilion including at least one affixation groove, said method comprising:

placing the stone in the wax model with the pavilion facing toward the wax model and the table facing away from the wax model;

applying heat and pressure to the table of the stone to an extent necessary to at least partially melt that portion of the wax model immediately adjacent to the pavilion of the stone whereby the wax penetrates at least a portion of said groove; and allowing the stone and wax model to cool.

2. The method of claim 1, wherein the step of applying heat and pressure to the table of the stone comprises:

applying a heated element to the table of the stone for a period of time sufficient to raise the temperature of the stone to approximately 40° C.

3. The method of claim 1, wherein the step of applying heat and pressure to the table of the stone comprises:

using hand pressure to apply a heated element to the table of the stone for a period of time sufficient to raise the temperature of the stone to approximately 40° C.

4. The method of claim 3, wherein the period of time can vary from 5 to 30 seconds depending on the size and weight of the stone.

5. A method of affixing a stone onto a piece of jewelry, the stone including a table on one side thereof, a converging pavilion on an opposite side thereof and a girdle therebetween, said method comprising:

modifying the stone, said modification consisting of forming at least one affixation groove in the pavilion of the stone;

forming a wax model of the stone-receiving portion of the piece of jewelry;

placing the stone on the wax model with the pavilion facing toward the wax model and the table facing away from the wax model;

applying heat and pressure to the table of the stone to an extent necessary to at least partially melt that portion of the wax model immediately adjacent to the pavilion of the stone whereby wax penetrates at least a portion of the affixation groove; allowing the stone and wax model to cool; and using the lost wax casting method to cast mounting material in place of the wax model, the wax model being configured so that the mounting material is not visible when the piece of jewelry is viewed from the table side of the stone.

6. The method of claim 5, wherein said forming at least one affixation groove comprises:

cutting the groove into the stone using a blade which is advanced toward and into the pavilion of the stone at an angle of ninety degrees; and causing relative rotation between the stone and the blade whereby a generally annular groove is formed, said groove circumscribing the pavilion of the stone.

7. The method of claim 5, wherein forming at least one affixation groove comprises:

cutting a first linear groove into the stone using a blade which is advanced toward and into the pavilion of the stone at an angle of ninety degrees; and cutting a second linear groove into the stone using a blade which is advanced toward and into the pavilion of the stone at an angle of ninety degrees.

8. The method of claim 5, wherein forming at least one affixation groove comprises:

cutting a groove defined by two symmetric adjoining walls.

9. The method of claim 5, wherein forming at least one affixation groove comprises:

cutting a groove defined by two opposing sidewalls and an adjoining bottom wall.

* * * * *